United States Patent [19]

Takegawa

[11] Patent Number: 4,658,866

[45] Date of Patent: Apr. 21, 1987

[54] METHOD OF AND APPARATUS FOR REMOVING AND REPLACING A BROKEN WEFT YARN

[75] Inventor: Yujiro Takegawa, Ishikawa, Japan

[73] Assignee: Tsudakoma Corp., Kanazawa, Japan

[21] Appl. No.: 762,667

[22] Filed: Aug. 5, 1985

[30] Foreign Application Priority Data

| | | | |
|---|---|---|---|
| Aug. 6, 1984 | [JP] | Japan | 59-165338 |
| Sep. 6, 1984 | [JP] | Japan | 59-187512 |
| Nov. 14, 1984 | [JP] | Japan | 59-240152 |

[51] Int. Cl.[4] ..... D03D 47/36

[52] U.S. Cl. ..... 139/450; 139/452

[58] Field of Search ..... 139/1 R, 11, 116, 429, 139/435, 450, 452

[56] References Cited

U.S. PATENT DOCUMENTS

| | | | |
|---|---|---|---|
| 4,410,018 | 10/1983 | Simpson | 139/450 |
| 4,559,976 | 12/1985 | Araki et al. | 139/452 |

FOREIGN PATENT DOCUMENTS

| | | |
|---|---|---|
| 45-26590 | 9/1970 | Japan . |
| 46-25543 | 7/1971 | Japan . |
| 53-38749 | 4/1978 | Japan . |

*Primary Examiner*—Henry S. Jaudon

*Attorney, Agent, or Firm*—Flynn, Thiel, Boutell & Tanis

[57] ABSTRACT

When a weft yarn is broken between a yarn supply and a main nozzle in a weft inserter, the weft yarn is automatically removed and replaced by threading a new weft yarn to a prescribed position in a storage drum and then carrying out auxiliary winding of the new weft yarn around the storage drum. The new weft yarn wound around the storage drum is then threaded to the main nozzle.

11 Claims, 14 Drawing Figures

METHOD OF AND APPARATUS FOR REMOVING AND REPLACING A BROKEN WEFT YARN

BACKGROUND OF THE INVENTION

1. Field of the Invention

The present invention relates to a method of and an apparatus for removing and replacing a weft yarn when it is broken in the yarn inserter in a jet loom.

2. Description of the Prior Art

The replacement of broken weft yarns in jet looms is disclosed in Japanese Patent Publication Nos. 45-26590 and 46-25543. In each of the disclosed arrangements, the end of a weft yarn is drawn by an air stream to a prescribed position, but the weft yarn is not automatically guided but instead is manually guided. More specifically, when the weft yarn is broken during a weaving process, the end of the weft yarn is required to be manually drawn from a yarn supply to the open end of a guide tube or the like. At the time the weft yarn is cut off between the yarn supply and a main nozzle during a weaving process, the weft yarn has to be manually wound as by a rotating yarn guide in as many turns as required around the storage drum in a weft storage device. In view of the above conventional practice, there have been demands for automatic weft threading arrangements and automatic auxiliary weft winding arrangements.

Japanese Laid-Open Patent Publication No. 53-38749 reveals a device for threading a metered weft yarn through a weft inserting nozzle. The weft yarn threading device operates by first storing the metered weft yarn as loops on an air stream in a storage tube and then guiding the weft yarn to the weft inserting nozzle. Therefore, the disclosed weft yarn threading device could not be incorporated in a drum-type weft storage device.

Drum-type weft storage devices have widely been employed in the art. There have also been demands in the art for a method of and an apparatus for automatically threading a weft yarn in the drum-type weft storage devices.

SUMMARY OF THE INVENTION

It is an object of the present invention to automatically remove and replace a weft yarn when it is broken in a weft inserter so that the weft yarn can be woven again.

Another object of the present invention is to automatically thread the end of a new weft yarn to a prescribed position in a storage device when the weft yarn is broken during a weaving process, so that the burden of the weft yarn threading operation is reduced and the availability of the loom is increased.

According to the present invention, there are at least two yarn supplies, and yarn ends from the yarn supplies are held by clamps. When the weft yarn is broken, the open end of a yarn guide tube is moved to the end of the weft yarn, which is then automatically drawn into the guide tube by a suction air stream so that the yarn end can automatically be fed to a prescribed position or a yarn guide of the storage device. The above operation can be effected by a simple sequence control circuit.

Still another object of the present invention is to automatically wind the end of a new weft yarn around a storage drum when the weft yarn is broken between a yarn supply and a main nozzle during a weaving process, so that the burden of auxiliary winding of the weft yarn is reduced and the auxiliary winding of the weft yarn can be carried out in a short period of time.

According to the present invention, when the weft yarn is broken between the yarn supply and the main nozzle, the new weft yarn from the yarn supply is drawn into and held in a suction pipe which is fixedly positioned. By rotating a yarn guide, the weft yarn can be stored in advance as a required number of turns around the outer peripheral surface of the storage drum. Since the yarn storage operation is automatically performed when the weft yarn is broken between the yarn supply and the main nozzle, the auxiliary winding of the weft yarn is automatized and hence the time required for the auxiliary winding of the weft yarn is shortened.

A still further object of the present invention is to automatically thread a weft yarn wound around the storage drum of a drum-type weft yarn storage device to a weft inserting main nozzle for allowing a loom to be restarted.

According to the present invention, the leading end of the weft yarn wound around the storage drum is drawn into a suction pipe, and the suction pipe is moved to move the leading end of the weft yarn toward the inlet end of the main nozzle. Thereafter, the weft yarn is moved in the vicinity of the inlet end of the main nozzle by first and second guide members, is cut off in a suitable position and is thereafter released. The end of the weft yarn is then drawn into the main nozzle under the suction thereof. The threading of the weft yarn is automatically performed between the storage drum and the main nozzle, with the result that the manual labor which has previously been required to thread the weft yarn through the main nozzle is eliminated and the time required for threading the weft yarn through the main nozzle is reduced.

The above and other objects, features and advantages of the present invention will become more apparent from the following description when taken in conjunction with the accompanying drawings, in which preferred embodiments of the present invention are shown by way of illustrative example.

DESCRIPTION OF THE PREFERRED EMBODIMENTS

Figure 1:
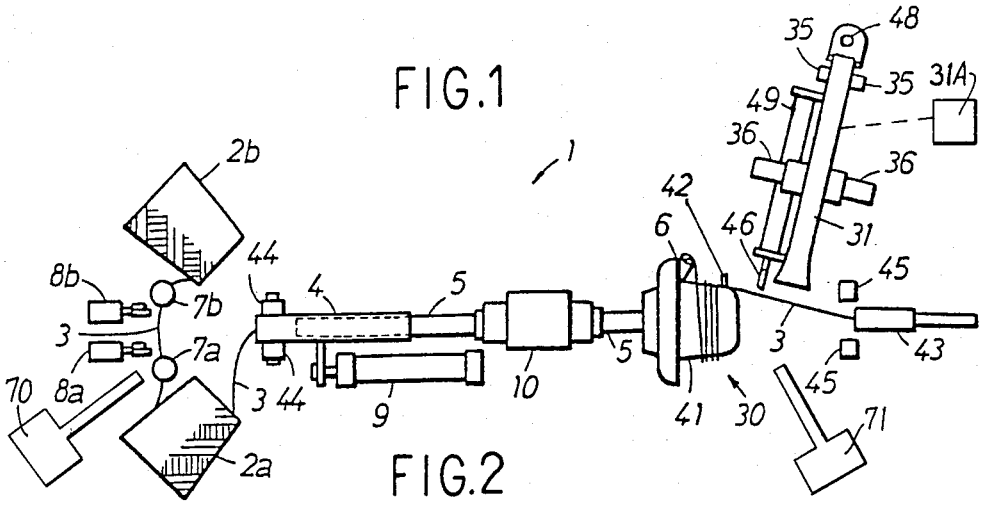
FIG. 1 is a schematic plan view of an apparatus for mending a weft yarn according to the present invention.

FIG. 1 shows an apparatus 1 for removing and replacing a broken weft yarn according to the present invention.

In the apparatus 1, a weft yarn 3 is drawn from two yarn supplies 2*a*, 2*b*. more specifically, the leading end of the weft yarn 3 supplied from the yarn supply 2*a* is delivered through guide tubes 4, 5 to a rotatable yarn guide 6, while the trailing end of the yarn 3 on the yarn supply 2*a* is joined to the leading end of the weft yarn 3 on the other yarn supply 2*b*. The weft yarn 3 extending between the yarn supplies 2*a*, 2*b* is supported by two clamps 7*a*, 7*b* and can be cut off by two cutters 8*a*, 8*b*.

The guide tube 4 is inserted in the fixed guide tube 5 so that they are telescopically slidable with respect to each other. The guide tube 4 can be driven by a drive cylinder 9 to move the open end thereof to a position between the clamps 7*a*, 7*b*. A pair of yarn breakage sensors 44 of a photoelectric nature, for example, is mounted on the open end of the guide tube 4.

Figure 2:
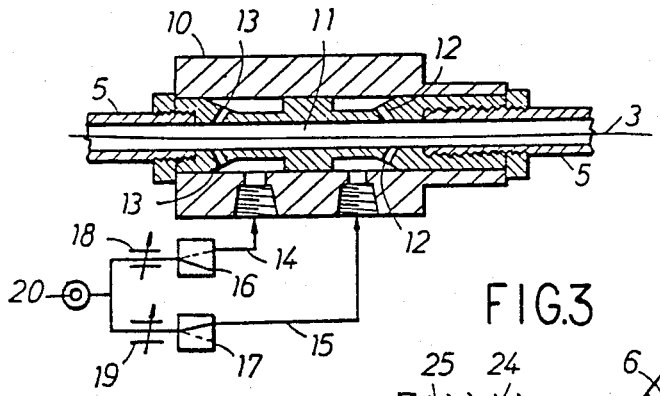
FIG. 2 is an enlarged cross-sectional view of a nozzle body which is a component of the apparatus of FIG. 1.

A nozzle body 10 is mounted on the guide tube 5. As shown in FIG. 2, the nozzle body 10 has a plurality of nozzle holes 12 slanted in the direction in which the weft yarn 3 is inserted and a plurality of nozzle holes 13 slanted in the opposite direction, the nozzle holes 12, 13 opening into a central guide hole 11. The nozzle holes 12, 13 are connected by pipes 14, 15, on-off valves 16, 17, and restrictions 18, 19 to a source 20 of air under pressure.

Figure 3:
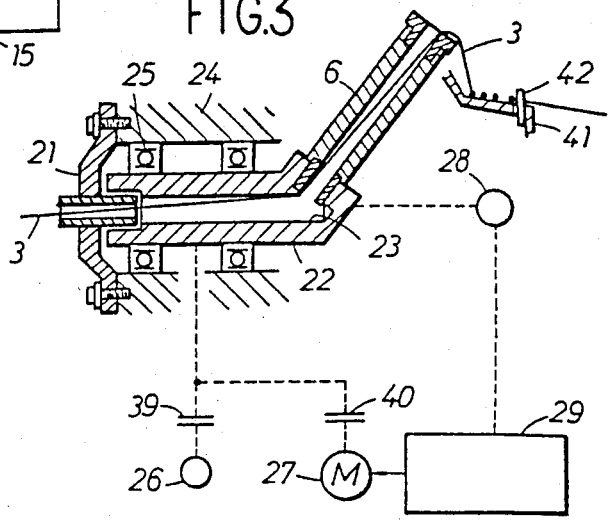
FIG. 3 is an enlarged cross-sectional view of a portion of the apparatus shown in FIG. 1.

The rotatable yarn guide 6 of a drum-type weft storage device 30 serves to wind the weft yarn 3 around a storage drum 41 as shown in FIGS. 1 and 3. The weft yarn 3 can be engaged on or released from the storage drum 41 by means of a pin 42 movable from or toward the storage drum 41 by either a cam mechanism driven by the main shaft 26 of the loom or an electromagnetic coil. The weft yarn 3 is guided from the storage drum 41 to a weft inserting main nozzle 43. A pair of yarn breakage sensors 45 of a photoelectric nature, for example, is disposed between the storage drum 41 and the main nozzle 43.

As illustated in FIG. 3, the end of the guide tube 5 is supported by a support body 21 screwed to a fixed frame 24 and is loosely fitted concentrically in the end of a yarn guide hole 23 in a rotatable shaft 22. The rotatable shaft 22 is rotatably supported by bearings 25 in the fixed frame 24 and is drivable at an approximate speed reduction ratio by the main shaft 26 through a clutch 39. The rotatable shaft 22 can also be rotated by an auxiliary winding motor 27 through a clutch 40. To the rotatable shaft 22, there is connected an encoder 28 for facilitating stopping of the rotatable yarn guide 6 at a prescribed angular displacement at all times. The rotation and stoppage of the auxiliary winding motor 27 is controlled by a control circuit 29.

Figure 4:
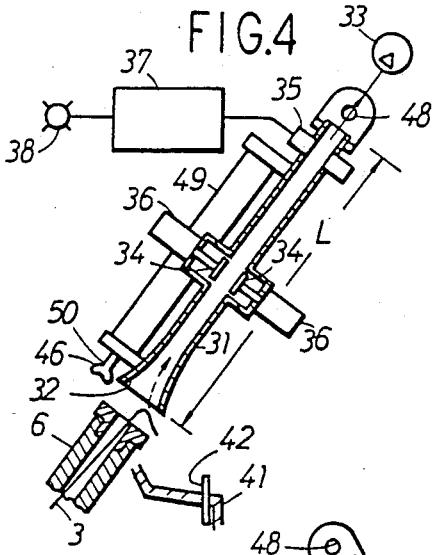
FIG. 4 is an enlarged cross-sectional view of a suction pipe of the apparatus of the invention.

FIG. 4 shows a suction pipe 31 which cooperates with a first guide member 46 and a second guide member 47 (FIGS. 6 and 7) in threading the weft yarn. The suction pipe 31 has a flaring suction port 32 positioned in registry with the open end of the rotatable yarn guide 6 as it is stopped. The suction pipe 31 is rotatably supported at its read end by a shaft 48 and connected to a suction source 33 such as a vacuum pump. The suction pipe 31 has a length L greater than the distance between the storage drum 41 of the weft storage device 30 and the weft inserting main nozzle 43. A pair of clamps 34 is disposed in an intermediate position in the suction pipe 31. A pair of sensors 35 of a photoelectric nature, for example, is mounted on the rear end of the suction pipe 31. The clamps 34 are drivable by electromagnetic solenoids 36, for example. The sensor 35 has an output terminal connected to a control circuit 37 for energizing an indicator lamp 38.

Figure 7:
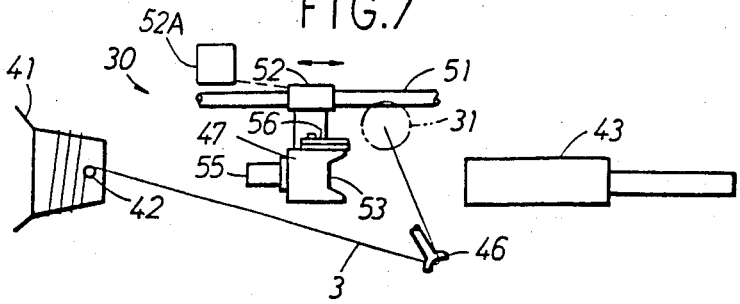
FIG. 7 is a plan view showing the manner in which the weft yarn is threaded.
Figure 8:
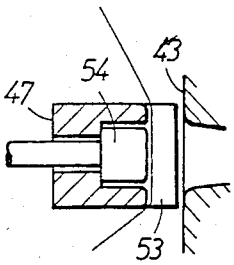
FIGS. 8 through 10 are cross-sectional views illustrative of operation of the apparatus, FIG. 10 showing a modification of the embodiment of FIG. 9.
Figure 9:
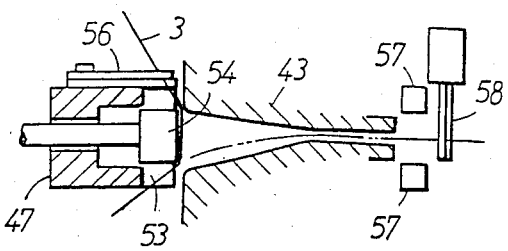
Figure 10:
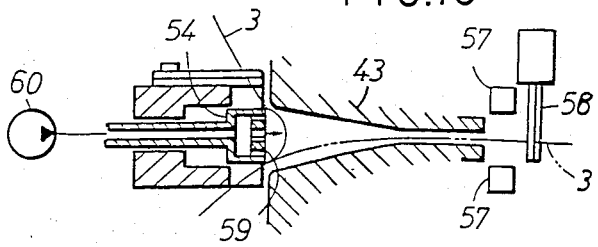

The first guide member 46 is attached to the distal end of a piston rod 50 of an air cylinder 49 mounted on a side of the suction pipe 31. The second guide member 47 is supported on a guide 51 (FIG. 6) extending parallel to the central axis of the main nozzle 4 by a slider 52 (FIG. 7) slidable along the guide 51, the second guide member 47 being positioned coaxially with the main nozzle 43. The second guide member 47 supports a cutter 56 on its side nearest the suction pipe 31 and defines a vertically opening recess 53 in confronting relation to the inlet end of the main nozzle 43. As shown in FIGS. 8 and 9, a pusher 54 is housed in the recess 53 in the second guide member 47 so as to project out of the recess 53. The pusher 54 is drivable by an electromagnetic solenoid 55 attached to the back of the second guide member 47. As shown in FIGS. 9 and 10, a pair of photoelectric sensors 57 and a cutter 58 are disposed at the distal end of the main nozzle 43.

Operation of the apparatus 1 will be described below.

As shown in FIG. 1, the weft yarn 3 drawn from the yarn supply 2*a* is delivered through the guide tube 4 as it is retracted, the guide tube 5, the guide hole 11 in the nozzle body 10, and the yarn guide hole 23 in the rotatable shaft 22 to the rotatable yarn guide 6 of the weft storage device 30. The weft yarn 3 is guided out of the yarn guide 6 and wound around the storage drum 41. When the pin 42 projects past the outer peripheral surface of the storage drum 41, the weft yarn 3 is engaged by the pin 42. Therefore, the rotatable yarn guide 6 as it rotates winds the weft yarn 3 as successive turns around the storage drum 41 which is held at rest. At this time, the weft yarn 3 is engaged by the pin 42 and reaches the weft inserting main nozzle 43. When the pin 42 is retracted, the stored weft yarn 3 is released and inserted with a weft inserting fluid through a warp shed by the weft nserting main nozzle 43. The storage and insertion of the weft yarn 3 are carried out in synchronism with the rotation of the main shaft 26 at all times. During the weaving process, the on-off valve 16 is open to eject an air stream into the guide hole 11 through the nozzle holes 13 in the direction opposite to the weft inserting direction. Therefore, the weft yarn 3 as it is drawn is suitably tensioned. The tension of the weft yarn 3 can be selected by adjusting the restriction 18.

Figure 5:
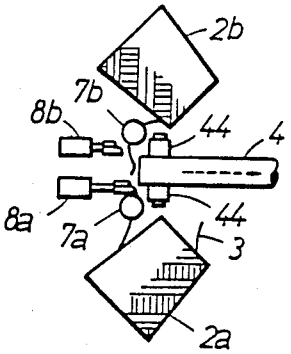
FIG. 5 is a fragmentary plan view of the apparatus, showing the manner in which a weft yarn is threaded into a guide tube.

When the weft yarn 3 is broken between the yarn supply 2*a* and the yarn guide 6, the yarn breakage is detected by the yarn breakage sensors 44. Thereafter, the loom is stopped at a suitable angle, and the clutch 39 between the main shaft 26 and the rotatable shaft 22 is disengaged and the clutch 40 is engaged to enable the auxiliary winding motor 27 to rotate the rotatable shaft 22. The weft yarn 3 extending in the guide tubes 4, 5 and on the storage drum 41 toward the main nozzle 43 is completely removed by the main nozzle 43 and a weft yarn remover (not shown), whereupon the sensors 45 between the storage drum 41 and the main nozzle 43 issue an output signal. Subsequently, when the yarn guide 6 is stopped in a position confronting the suction pipe 31, the suction source 33 is actuated, and the air cylinder 9 moves the guide tube 4 to displace its open end toward the end of the weft yarn 3 on the other yarn supply 2*b* as shown in FIG. 5. The on-off valve 17 is actuated now to eject air under pressure from the nozzle holes 12 for generating a suction air stream in the guide tube 4. The weft yarn 3 from the yarn supply 2*b* is cut off by the cutter 8*a* between the clamps 7*a*, 7*b*. As the clamp 7*b* releases the weft yarn 3, the end thereof is introduced into the guide tube 4 and delivered through the guide tube 5 into the rotatable yarn guide 6. The weft yarn 3 is then drawn from the distal end of the yarn guide 6 into the suction pipe 31 confronting the yarn guide 6. When a certain length of the weft yarn 3 is drawn into the suction pipe 31, the sensors 35 issue an output signal to close the on-off valve 17. Thereafter, the solenoids 36 are actuated to cause the clamps 34 to clamp the weft yarn 3 in the suction pipe 31, and the on-off valve 16 is actuated to give a suitable tension to the weft yarn 3 between the clamps 34 and the yarn supply 2*b*. The yarn guide 6 is rotated to wind the weft yarn 3 as necessary around the storage drum 41 until the required number of weft yarn turns are detected by the encoder 28, whereupon the weft yarn 3 has been properly stored on the storage drum 41. Therefore, the weft yarn 3 is automatically threaded from the yarn supply 2*b* to the rotatable yarn guide 6.

Since the new weft yarn 3 is automatically drawn into the guide tubes 4, 5 and threaded to a prescribed position on the weft yarn storage device 30 when the weft yarn 3 is broken, the process of threading the weft yarn 3 is not required to be manually done by the operator and the downtime of the loom is shortened upon weft yarn breakage.

The new weft yarn 3 is thereafter threaded through the main nozzle 43 in a threading process, described below. Therefore, when the weft yarn 3 is broken in an upstream section, the operation is successively carried out downstream of the yarn breakage under sequence control.

When the weft yarn 3 is broken between the storage drum 41 and the main nozzle 43, the yarn breakage is detected by the sensors 45, which condition stops the operation of the loom. Thereafter, the rotatable shaft 22 is disconnected by the clutch 39 from the main shaft 26, and the yarn guide 6 is rotated in the reverse direction by the auxiliary winding motor 27 through the clutch 40. The weft yarn 3 remaining on the storage drum 41 is then discharged by an air stream flowing from the on-off valve 16 toward the yarn supplies 2*a*, 2*b* toward a suction device 70 disposed closely to the yarn supplies 2*a*, 2*b*. The yarn breakage sensors 44 issue an output to effect an automatic yarn threading operation in the same manner as the automatic yarn threading cycle at the time of a yarn breakage between the yarn supplies 2*a*, 2*b* and the guide tubes 4, 5.

At this time, the weft yarn 3 is drawn from the distal end of the yarn guide 6 by the suction air stream through the suction port 32 into the suction pipe 31. When he weft yarn 3 is detected by the sensors 35 in the suction pipe 31, the control circuit 37 energizes the indicator lamp 38 to allow the operator to visually confirm the threading of the weft yarn 3.

Figure 13:
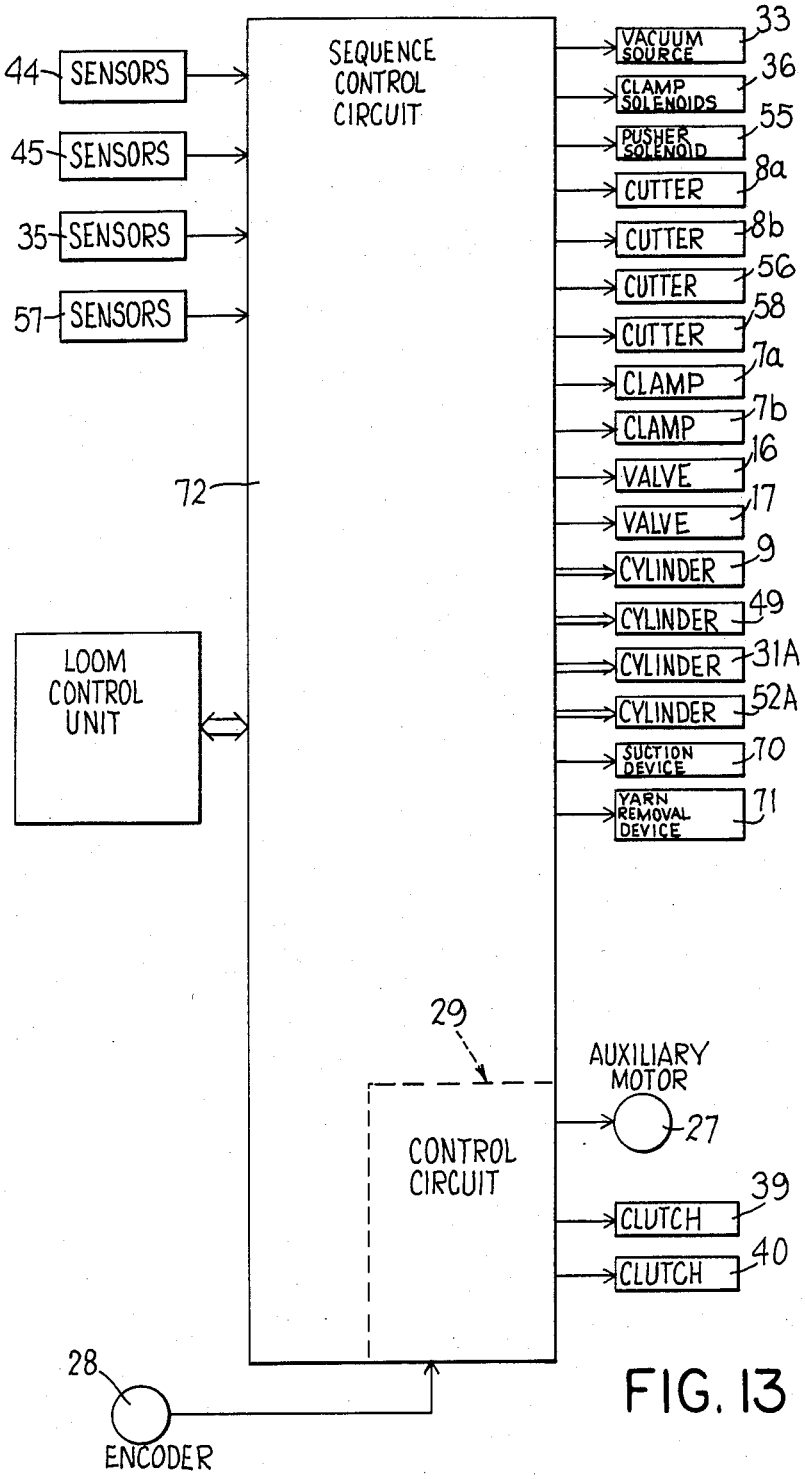
FIG. 13 is a diagrammatic view of a sequence control circuit for the apparatus of FIG. 1.
Figure 14:
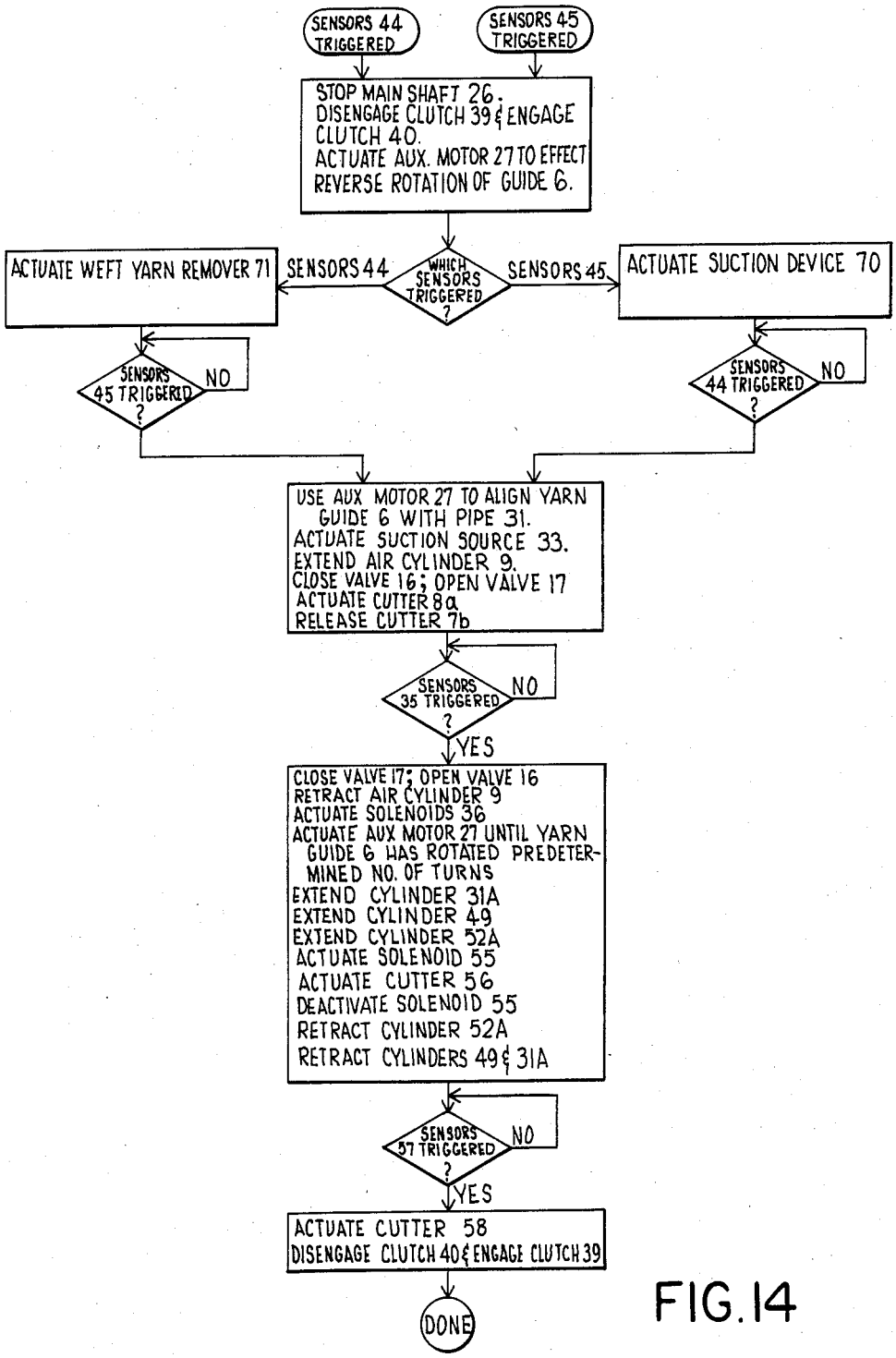
FIG. 14 is a flow chart showing a control sequence carried out by the sequence control circuit of FIG. 13 to effect automatic removal and replacement of a broken yarn.

Then, the electromagnetic solenoids 36 are energized to close the clamps 34 in the suction pipe 31 to grip the weft yarn 3 therein. Thereafter, the auxiliary winding motor 27 is rotated again to rotate the yarn guide 6 until the weft yarn 3 is wound as required turns on the outer peripheral surface of the storage drum 41. At this time, the weft yarn 3 is gripped at one end by the clamps 34 and wound around the storage drum 41 irrespective of whether the pin 42 is advanced or retracted. After the required number of turns of the weft yarn 3 have been wound, the auxiliary winding motor 27 is controlled by the control circuit 29 to be automatically stopped. The above sequence of operation can automatically be performed as by a sequence control circuit 72 (FIG. 13) supplied with output signals from the encoder 28, the sensors 35, and the like, and a signal indicative of a weft yarn breakage.

As described above, when the weft yarn 3 is broken between the yarn supplies 2*a*, 2*b* and the main nozzle 43, the end of the weft yarn 3 is drawn and held in the suction pipe 31. Therefore, the required length of the weft yarn 3 can be stored in advance around the storage drum 41 by the rotation of the yarn guide 6 irrespective of the condition of the pin 42, and the loom can then be restarted. As a consequence, no manual auxiliary winding operation is required, resulting in the saving of labor and a shortened downtime of the loom.

Figure 6:
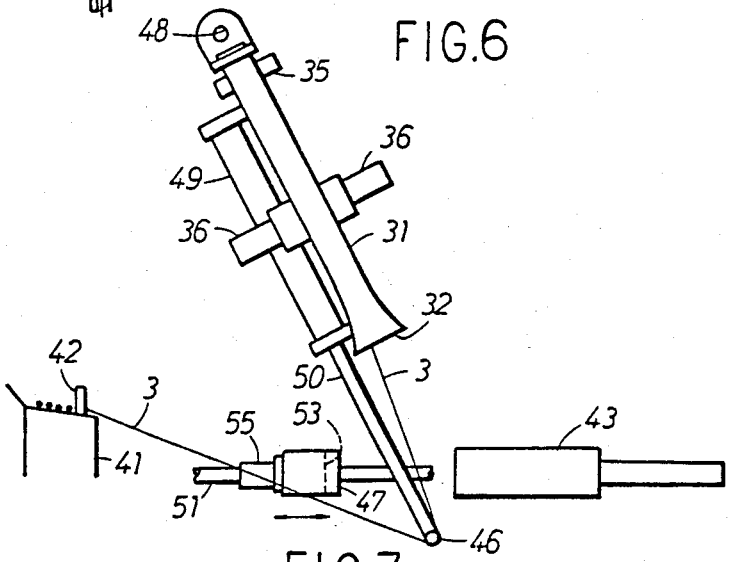
FIG. 6 is a side elevational view showing the manner in which a weft yarn is threaded.

After the weft yarn 3 has been released from the clamps 34, the suction pipe 31 is turned about the shaft 48 as shown in FIG. 6 to bring the suction port 32 thereof toward the inlet end of the main nozzle 43. The suction pipe 31 can be angularly moved by a step motor or an air cylinder 31A. The air cylinder 49 then projects its piston rod 50 to enable the first guide member 46 to move the weft yarn 3 between the storage drum 41 and the suction pipe 31 in the direction in which the piston rod 50 is moved, as shown in FIGS. 6 and 7. The weft yarn 3 between the first guide member 46 and the suction pipe 31 is now caused to extend across the central axis of the main nozzle 43 and to be positioned between the main nozzle 43 and the second guide member 47.

Then, the second guide member 47 is guided by the slider 52 toward the inlet end of the main nozzle 43. The slider 52 can be moved as by an air cylinder 52A. As the second guide member 47 moves toward the main nozzle 43, the weft yarn 3 enters the recess 53 and moves toward the inlet end of the main nozzle 43 as shown in FIG. 8.

The electromagnetic solenoid 55 is energized to press the pusher 54 toward the inlet end of the main nozzle 43 for positioning the weft yarn 3 at the inlet end of the main nozzle 43 as illustrated in FIG. 9. Then, the cutter 56 cuts off the weft yarn 3 between the suction pipe 31 and the second guide member 47, and the weft yarn 3 is allowed to be drawn into the main nozzle 43. Since the main nozzle 43 generates a suction air stream at this time, the cut weft yarn 3 is introduced into the main nozzle 43 through its inlet end after the weft yarn 3 has been released by the pusher 54 and the first guide member 46 returns to its original position.

After the weft yarn 3 has been threaded through the main nozzle 43, the suction pipe 31 and the second guide member 47 go back to their original positions. The weft yarn 3 as it is threaded through the main nozzle 43 can be electrically detected by the sensors 57 positioned at the distal end of the main nozzle 43. At the distal end of the main nozzle 43, the weft yarn 3 is cut off to a suitable length by the cutter 58. The loom is therefore automatically brought to the conditon in which it can be restarted.

As described above, the end of the weft yarn 3 wound around the storage drum 41 is guided by the suction pipe 31 toward the main nozzle 43, and is automatically guided toward the inlet end of the main nozzle 43 by the first and second guide members 46, 47. Therefore, the weft yarn 3 can be threaded through the main nozzle 43 automatically and in a labor saving manner. Inasmuch as the suction pipe 31 can be used for threading the weft yarn 3 through the main nozzle 43 in relation to the auxiliary winding operation, the auxiliary winding of the weft yarn 3 and the threading of the weft yarn 3 through the main nozzle 43 can successively be performed.

While in the above embodiment the pusher 54 only releases the weft yarn 3, the weft yarn 3 may positively be forced into the main nozzle 43 by ejecting air through a plurality of nozzle holes 59 in the pusher 54 as shown in FIG. 10. More specifically, air under pressure supplied from an air source 60 is ejected through the nozzle holes 59 as air streams toward the inlet end of the main nozzle 43 when the weft yarn 3 is to be threaded through the main nozzle 43.

Figure 11:
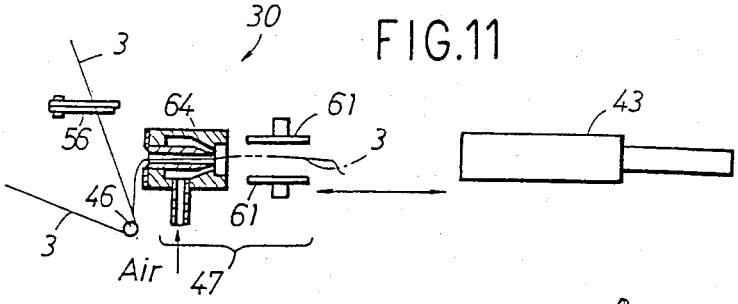
FIGS. 11 and 12 are fragmentary plan views, partly in cross section, of arrangements according to other embodiments of the present invention.

Although the second guide member 47 in the first embodiment only serves to loosely hold the weft yarn 3 and guide the same toward the main nozzle 43, the second guide member 47 may be composed of an air guide 64 having suction and nozzle functions and clamps 61 as shown in FIG. 11. In FIG. 11, the weft yarn 3 drawn by the air guide 64 is clamped by the clamps 61 and guided thereby toward the inlet end of the main nozzle 43.

Figure 12:
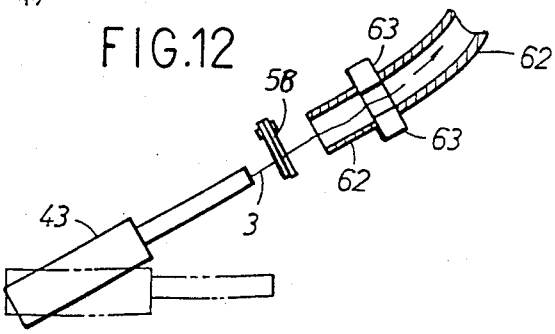

The weft yarn 3 may be threaded through the main nozzle 43, as shown in FIG. 12, by rotating the main nozzle 43 through an appropriate angle to direct the end thereof toward an auxiliary suction pipe 62 disposed in a position deviated from the weft inserting direction, drawing the end of the weft yarn 3 into the auxiliary suction pipe 62 with an air stream therein, confirming the presence of threaded weft yarn 3 with a pair of sensors 63 positioned in the auxiliary suction pipe 62, and then cutting the weft yarn 3 with the cutter 58.

While the guide tube 4 is driven by the air cylinder 9 in the first embodiment, the guide tube 4 may be driven by a stepping motor and a rack and pinion. The suction pipe 31 may be fixed in a position corresponding to the yarn guide 6, or may be movable back and forth by a cylinder. Since the air stream in the suction pipe 31 may be generated in the direction to draw the weft yarn 3, the air stream can be generated as a suction air stream from a vacuum source or as an ejected air stream from a source of air under pressure.

Although certain preferred embodiments have been shown and described, it should be understood that many changes and modifications may be made therein without departing from the scope of the appended claims.

What is claimed is:

1. A method of removing and replacing a broken weft yarn in a weft inserter wherein weft yarn ends from at least two yarn supplies are joined to each other, the connected weft yarn ends are held by clamps between the yarn supplies, and the leading end of the weft yarn from one of the yarn supplies is delivered through a guide tube toward a weft yarn storage device, said method comprising the steps of moving an open end of the guide tube toward the position of the weft yarn held by the clamps when the weft yarn from said one yarn supply is broken, cutting off the weft yarn in the vicinity of the clamps, thereafter releasing the weft yarn from said clamps, and drawing the weft yarn from the other yarn supply into said guide tube by causing a suction air stream to flow in the guide tube.

2. An apparatus for removing and replacing a broken weft yarn, comprising at least two yarn supplies having yarn ends which are joined to each other, clamps for holding the interconnected weft yarn ends between said yarn supplies, a guide tube for delivering a leading end of the weft yarn from one of the yarn supplies toward a weft yarn storage device, feed means for moving an open end of said guide tube toward the position of the weft yarn held by said clamps when the weft yarn drawn from said one yarn supply is broken, a cutter for cutting off the weft yarn in the vicinity of said clamps, and suction means for drawing the weft yarn from the other yarn supply into said guide tube by causing a suction air stream to flow in the guide tube when the weft yarn is released from said clamps.

3. An apparatus according to claim 2, wherein said suction means comprises a nozzle body disposed on said guide tube and having nozzle holes defined therein for ejecting air streams through a central opening therein in the direction in which the weft yarn is inserted through the central opening.

4. A method of removing and replacing a broken weft yarn in a weft yarn storage device wherein the weft yarn is wound and metered around a stationary storage drum by a rotatable yarn guide, is stored on said storage drum, and is maintained on and released from said storage drum by a pin movable toward and away from a peripheral surface of said storage drum, said method comprising the steps of stopping said rotatable yarn guide at a prescribed angular position when the weft yarn is broken between a yarn supply and a main nozzle, thereafter drawing the weft yarn from said yarn guide into a pipe with an air stream, and rotating said yarn guide to wind the drawn weft yarn a prescribed number of turns around the outer peripheral surface of said storage drum to let the weft yarn be stored in advance thereon.

5. An apparatus for removing and replacing a broken weft yarn, comprises a weft yarn storage device wherein the weft yarn is wound and metered around a stationary storage drum by a rotatable yarn guide, is stored on said storage drum, and is maintained on and released from said storage drum by a pin movable toward and away from a peripheral surface of said storage drum, said apparatus further including stopping means for stopping said rotatable yarn guide at a prescribed angular position when the weft yarn is broken between a yarn supply and a main nozzle, a pipe positioned in confronting relation to said yarn guide when it is stopped, means for drawing the weft yarn into said pipe by causing an air stream to flow therein, and auxiliary winding motor means for rotating said rotatable yarn guide after the weft yarn has been drawn into said pipe.

6. A method of removing and replacing a broken weft yarn, comprising the steps of drawing the leading end of the weft yarn wound around a storage drum into a suction pipe, moving said suction pipe so as to move the leading end of the weft yarn toward an inlet end of a main nozzle, moving a first guide member to cause the weft yarn in said suction pipe to extend across a central axis of said main nozzle, moving a second guide member along the central axis of said main nozzle so as to move the weft yarn extending across said central axis toward the inlet end of said main nozzle, cutting off the weft yarn between said second guide member and said suction pipe in the vicinity of said second guide member, and drawing the end of the weft yarn into said main nozzle under the suction of the main nozzle.

7. An apparatus for removing and replacing a broken weft yarn, comprising a suction pipe movable between positions respectively adjacent a storage drum and a weft inserting main nozzle, means for drawing into said pipe the leading end of the weft yarn wound around said storage drum by causing an air stream to flow in said pipe in the direction to draw the weft yarn into said suction pipe, a first guide member for moving the weft yarn in said suction pipe in a direction to extend across a central axis of the main nozzle, a second guide member for guiding the portion of the weft yarn between said suction pipe and said first guide member along the central axis of said main nozzle toward an inlet end of said main nozzle, and a cutter for cutting off the weft yarn between said second guide member and said suction pipe.

8. An apparatus according to claim 7, wherein said suction pipe is supported for pivotal movement between said positions respectively adjacent said storage drum and said main nozzle, and including an air cylinder mounted on said suction pipe and having a piston rod supporting said first guide member for back-and-forth movement.

9. An apparatus according to claim 8, wherein said second guide member is supported for movement along said central axis of the main nozzle, and including a pusher disposed in a recess defined in said second guide member in confronting relation to the inlet end of said main nozzle, said pusher being movable into and out of said recess.

10. An apparatus according to claim 9, wherein said pusher has nozzle holes for ejecting air.

11. An apparatus according to claim 7, wherein said second guide member comprises air guide means having suction and nozzle functions, and clamp means in the region of said air guide means.

* * * * *